US012276429B2

(12) United States Patent
Harkin

(10) Patent No.: US 12,276,429 B2
(45) Date of Patent: Apr. 15, 2025

(54) HEAT EXCHANGER CORE

(71) Applicant: SHIVA AIR CONDITIONING LTD, Dublin (IE)

(72) Inventor: Stephen Harkin, Dublin (IE)

(73) Assignee: SHIVA AIR CONDITIONING LTD (IE)

( * ) Notice: Subject to any disclaimer, the term of this patent is extended or adjusted under 35 U.S.C. 154(b) by 189 days.

(21) Appl. No.: 17/759,329

(22) PCT Filed: Jan. 21, 2021

(86) PCT No.: PCT/EP2021/051311
§ 371 (c)(1),
(2) Date: Jul. 22, 2022

(87) PCT Pub. No.: WO2021/148523
PCT Pub. Date: Jul. 29, 2021

(65) Prior Publication Data

US 2023/0039363 A1 Feb. 9, 2023

(30) Foreign Application Priority Data

Jan. 22, 2020 (GB) ..... 2000952

(51) Int. Cl.
*F24F 1/022* (2019.01)
*F24F 1/029* (2019.01)
(Continued)

(52) U.S. Cl.
CPC ..... *F24F 1/022* (2013.01); *F24F 1/029* (2019.02); *F24F 1/0323* (2019.02); *F24F 13/20* (2013.01);
(Continued)

(58) Field of Classification Search
CPC ..... F24F 1/0323; F24F 13/20; F24F 1/022; F24F 13/222; F24F 13/24; F24F 1/031; F24F 2013/242; F24F 1/029
See application file for complete search history.

(56) References Cited

U.S. PATENT DOCUMENTS 5,533,357 A 7/1996 Voorhis
6,131,652 A * 10/2000 Ito ..... B60H 1/00064 165/203

(Continued)

FOREIGN PATENT DOCUMENTS

GB 2520313 A 5/2015
JP S61280333 A 12/1986
WO 2015179850 A1 11/2015

*Primary Examiner* — Frantz F Jules
*Assistant Examiner* — Martha Tadesse
(74) *Attorney, Agent, or Firm* — Shumaker, Loop & Kendrick, LLP; Jeffrey B. Fabian

(57) ABSTRACT

A heat exchanger core for a heat pump, comprising a first chamber comprising a chamber body, the chamber body comprising an air inlet, an air outlet and a first heat exchange coil adjacent to the air inlet and inclined with respect to the air inlet; a second chamber comprising a chamber body, the chamber body having an air inlet, an air outlet and a second heat exchange coil adjacent the air inlet and inclined with respect to the air inlet; the first heat exchange coil and the second heat exchange coil forming a circuit for circulating refrigerant between the first heat exchange coil and the second heat exchange coil.

21 Claims, 7 Drawing Sheets

(51) Int. Cl.

| | |
|---|---|
| ***F24F 1/0323*** | (2019.01) |
| ***F24F 13/20*** | (2006.01) |
| ***F24F 13/22*** | (2006.01) |
| ***F24F 13/24*** | (2006.01) |

(52) U.S. Cl.
CPC ..... *F24F 13/222* (2013.01); *F24F 13/24* (2013.01); *F24F 2013/225* (2013.01); *F24F 2013/242* (2013.01)

(56) References Cited

U.S. PATENT DOCUMENTS

| | | | | |
|---|---|---|---|---|
| 2003/0217562 | A1* | 11/2003 | Pfannenberg ..... | H05K 7/20681 62/279 |
| 2004/0045304 | A1* | 3/2004 | Park ..... | F24F 13/222 62/186 |
| 2015/0016808 | A1* | 1/2015 | Yamaguchi ..... | F24H 9/06 392/360 |
| 2016/0298871 | A1* | 10/2016 | Gillatt ..... | F24F 13/0272 |
| 2017/0138617 | A1 | 5/2017 | Kim et al. | |
| 2019/0383516 | A1* | 12/2019 | Baba ..... | F24F 11/61 |

* cited by examiner

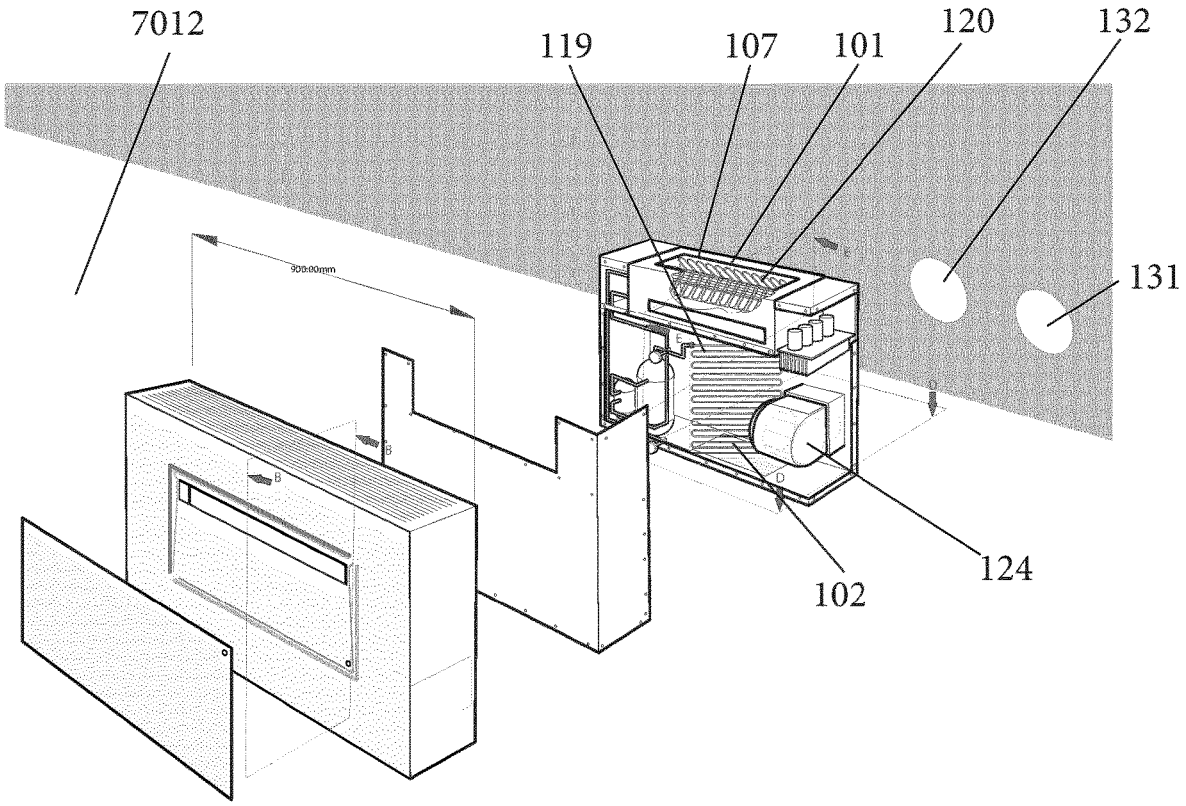
Fig 7
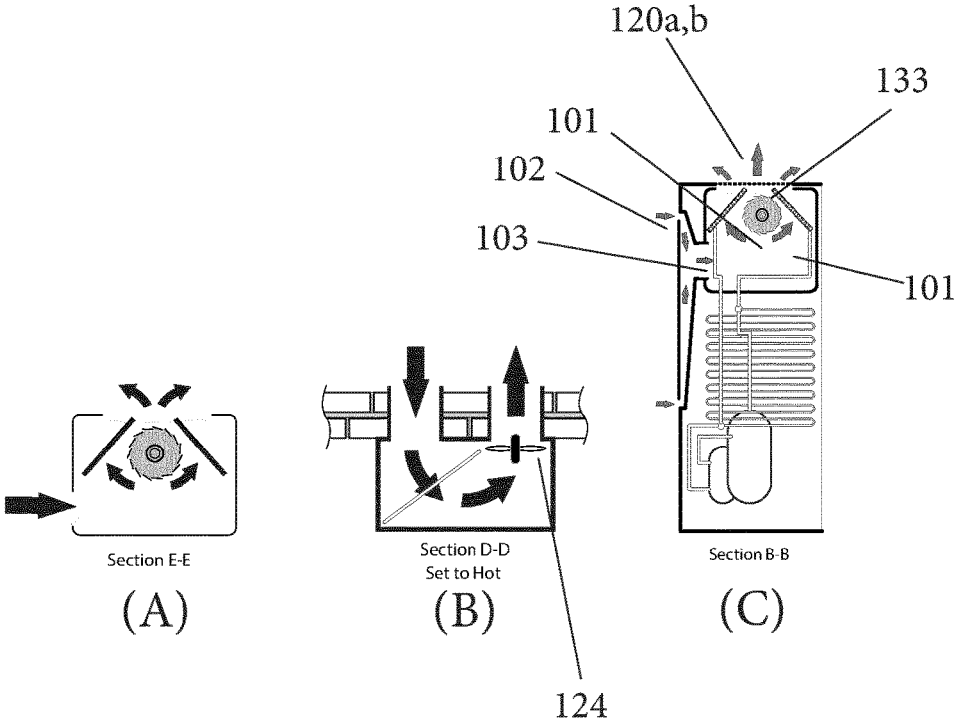

HEAT EXCHANGER CORE

CROSS-REFERENCE TO RELATED APPLICATIONS AND PRIORITY

The present application claims priority from International Application No. PCT/EP2021/051311, filed on Jul. 22, 2022, which is hereby expressly incorporated herein by reference in entirety.

TECHNICAL FIELD

The present invention is directed to heat exchanger cores and in particular heat exchanger cores for a heat pump or air conditioning unit.

BACKGROUND

Traditional heat pumps or air conditioning units for the domestic and light commercial market conventionally require a unit external to a building and a unit internal to the building. This limits their flexibility. While standalone units have been provided that are portable and thus useable within a building or home, they are inefficient, have high running costs and generally produce an uncomfortable and intrusive noise level. Traditional units further use inefficient fixed speed compressors. With standalone portable units and due to their use in a sealed room environment where there is no air exchange when exhausting, a vacuum can be created in the room in which the portable unit is used. A further disadvantage of such units is the requirement for compressors to have an exhaust outlet which is vented via a flexible hose or rigid duct. Air conditioning units/heat exchange units also require specialized installers and commissioners for each individual site where such a unit is installed. It is desirable to provide a standalone unit, which is easy to install and requires no commissioning. It is further desirable to provide a flexible unit that can be used for heating or cooling a room and which eliminates the necessity to have a component of the heat exchange unit external to a building. It is further desirable to provide a unit which can be installed in a variety of locations within a building or home, or for example in server racks which may not have an external venting point. It is further desirable to provide a unit which is efficient in terms of noise generated and operating cost.

The object of the present invention is to provide an improved heat exchanger core for a heat pump or air conditioning unit.

SUMMARY

In accordance with the present invention there is described a heat exchanger core comprising a first chamber comprising a chamber body, the chamber body comprising an air inlet, an air outlet and a first heat exchange coil adjacent to the air inlet and inclined with respect to the air inlet; a second chamber comprising a chamber body, the chamber body having an air inlet, an air outlet and a second heat exchange coil adjacent the air inlet and inclined with respect to the air inlet; the first heat exchange coil and the second heat exchange coil forming a circuit for circulating refrigerant between the first heat exchange coil and the second heat exchange coil. The inclined heat exchange coils optimize the surface area thus improving the efficiency of the air transfer and the cooling/heating mechanisms.

The refrigerant circuit may further comprises a compressor unit. The compressor unit may be located within the second chamber body. This provides a flexible configuration.

The first chamber body may extend between the air inlet and the air outlet, the first chamber body having a first wall and a second wall. The first heat exchange coil may slope from the first wall of the chamber adjacent the air inlet to the second wall of the first chamber.

The first heat exchange coil may comprise a first coil and a second coil, the first coil sloping from the first wall to a mid-point of the chamber and the second coil sloping from the second wall to the mid-point of the chamber The heat exchanger core according to any previous claim wherein the first heat exchange coil is inclined at an angle of between 15 to 75 degrees with respect to the air inlet.

The second chamber body may extend between the air inlet and the air outlet, the chamber body having a first wall and a second wall and wherein the first wall comprises the air inlet and the air outlet. The second heat exchange coil may slope from the second wall of the second chamber proximal the air inlet to the first wall of the second chamber. The second heat exchange coil may be inclined at an angle of between 15 and 75 degrees with respect to the air inlet.

The first chamber body may have a first volume adjacent the air inlet, a second volume adjacent the air outlet and a third volume between the first heat exchange coil and the air outlet, the third volume being less than the first volume and the second volume. The first chamber and second chamber may be positioned adjacent to one another such that the second wall of the first chamber and the second wall of the second chamber are in parallel. The heat exchanger core may further comprise means for collecting condensation from the first heat exchange coil.

The means for collecting condensation may comprise a drip tray and a diverter for diverting the condensation from the first heat exchange coil to the drip tray. The drip tray may further comprise a heating element for evaporating the condensation collected. This removes the need for a separate drainage mechanism and allows additional flexibility in locating the heat exchange unit.

The drip tray may further comprise a drain for draining the condensation. The second chamber may further comprise a fan unit. The fan unit may be an inverter driven exhaust fan. The first chamber and the second chamber may be locatable internally within a building. The refrigerant circuit may further comprise a reversing valve for reversing the fluid flow in the circuit. The first heat exchange coil may be an evaporator coil and the second heat exchange coil may be a condenser coil. Alternatively, the first heat exchange coil may be a condenser coil and the second heat exchange coil may be an evaporator coil.

In accordance with the present invention there is provided a unit for air conditioning or heat exchange comprising a heat exchanger core as described above. The heat exchanger core may be housed in a housing. The housing may comprise sound insulation. The housing may further comprise a fan unit. The housing may comprise a housing air inlet and a housing air outlet in communication with the air inlet and the air outlet of the second chamber. The housing may comprise a further air inlet and air outlet in communication with the air inlet and air outlet of the first chamber. The unit may further comprise sealing elements engaged with the housing air inlet and the housing air outlet of the second chamber. The unit may further comprise means for mounting the air conditioning unit on a wall or other planar surface. The means for mounting the air conditioning unit may comprise a first portion and a second portion, the first portion attachable to the air conditioning unit and the second portion attachable to the wall and wherein mounting the air conditioning unit on the wall comprises attaching the first portion to the second portion.

The unit as described above may be housed within a cupboard or a wardrobe. The first chamber and second chamber may both be located in the same room of a house or other building.

DESCRIPTION OF FIGURES

FIG. 7 is a view of an air conditioning unit in accordance with the present invention and cross sections taken through the air conditioning unit.

DETAILED DESCRIPTION

Figure 1:
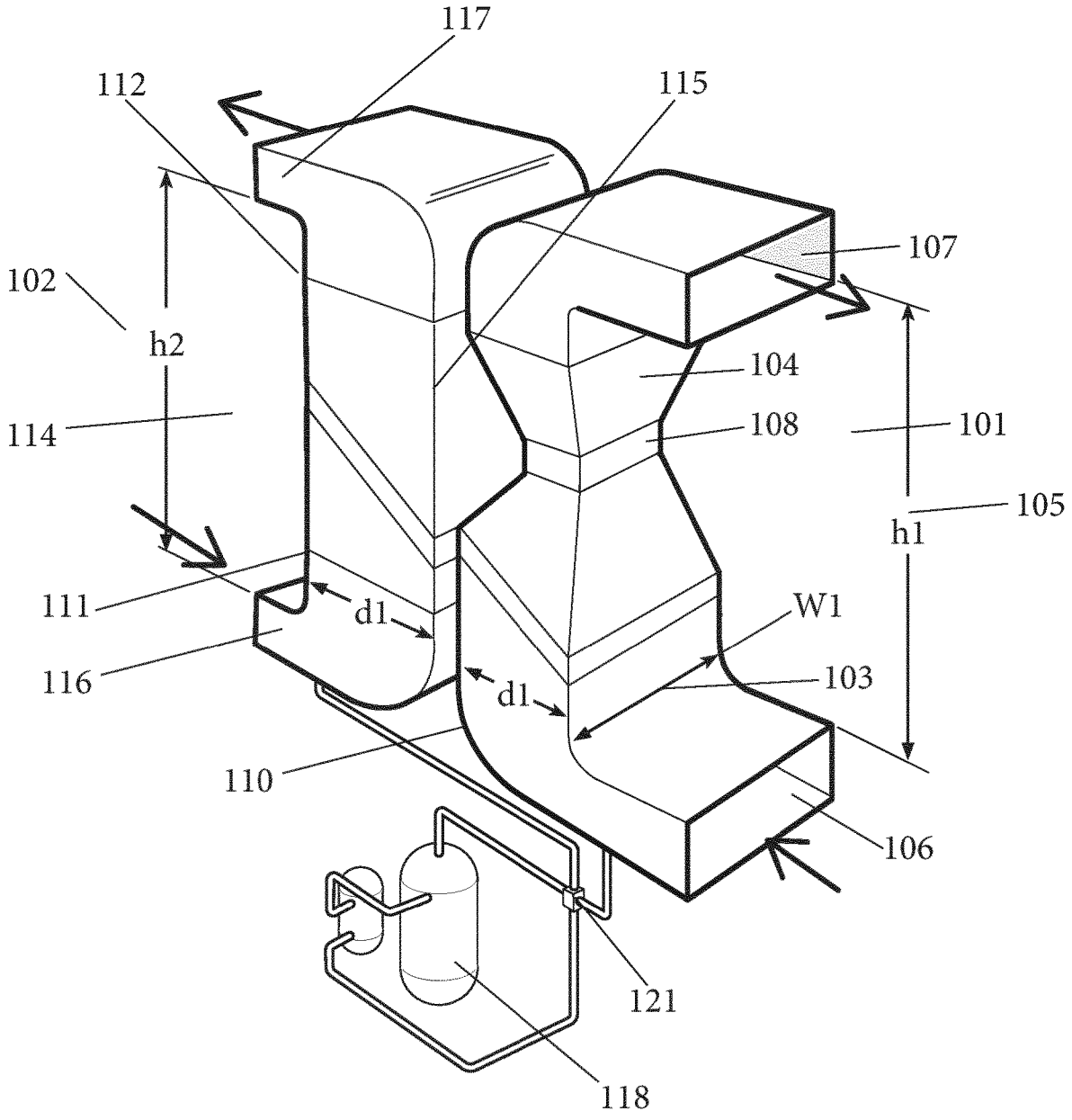
FIG. 1 is a perspective view of a heat exchanger core in accordance with the present invention.

A heat exchanger core comprises two chambers, a first chamber 101 and a second chamber 102.

The first chamber 101 has a chamber body 105 having an air inlet 103 and an air outlet 104. The first chamber has a first chamber body 105 which extends between the air inlet 103 and the air outlet 104.

The first chamber body has a first wall 109 and a second wall 110 which are substantially parallel and separated by a depth d1. The first wall and the second wall have a width w1. The chamber body 105 has a height h1.

In one configuration, the first chamber body 105 may have a substantially consistent volume between the air inlet 103 and the air outlet 104. In an alternative configuration, as shown in FIG. 1, the first chamber body may have a first volume adjacent the air inlet and a second volume adjacent the air outlet. In this configuration, a section 108 of the chamber body between the air inlet and the air outlet has a substantially smaller volume. The narrowing of the chamber or neck section creates a forced Venturi effect which increases static pressure in the chamber body, airflow through the coil(s), and also provides noise reduction on outlet airflow. An additional fan unit may also be provided in the neck section. Alternatively and wherein the volume of the first chamber is substantially consistent along the full height of the first chamber a separate fan unit may be provided in the absence of the neck section.

To guide the air flow through the chamber body the first chamber 101 as show in in FIG. 1 comprises a chimney or flue element 106 for guiding air flow into the air inlet 103. A second chimney of flue element 107 guides air flow from the air outlet. The first and second flue elements of FIG. 1 intake and exhaust the air at substantially right angles to the chamber body however, it will be appreciated that it first and second flue elements are not restricted as such. The flue sections may have a depth and width substantially similar to the depth and width of the chamber body. The flue sections may be C shaped, L shaped or the like. The flue elements in the embodiment of FIG. 1 intake and exhaust perpendicular to the first wall of the chamber. A fan element (not shown) may be provided in the intake flue for improving the intake of air. A second fan element (not shown) may optionally be provided in the exhaust flue for exhausting the air.

The second chamber 102 has a second chamber body 113 having an air inlet 111 and an air outlet 112. The second chamber has a second chamber body 113 which extends between the air inlet 111 and the air outlet 112. The second chamber body 113 has a first wall 114 and a second wall 115. The first and second wall are substantially parallel and separated by a depth d2.

The second chamber body has a first wall 109 and a second wall 110 which are substantially parallel and separated by a depth d2. The first wall and the second wall have a width w2. The second chamber body 113 has a height h2. In one configuration, the second chamber body 113 may have a substantially consistent volume between the air inlet 111 and the air outlet 112.

To guide the air flow through the second chamber body from the air inlet to the air outlet, the second chamber 102 as show in in FIG. 1 comprises a chimney or flue element 116 for guiding air flow into the air inlet 111. A second chimney of flue element 117 guides air flow from the air outlet.

Figure 2:
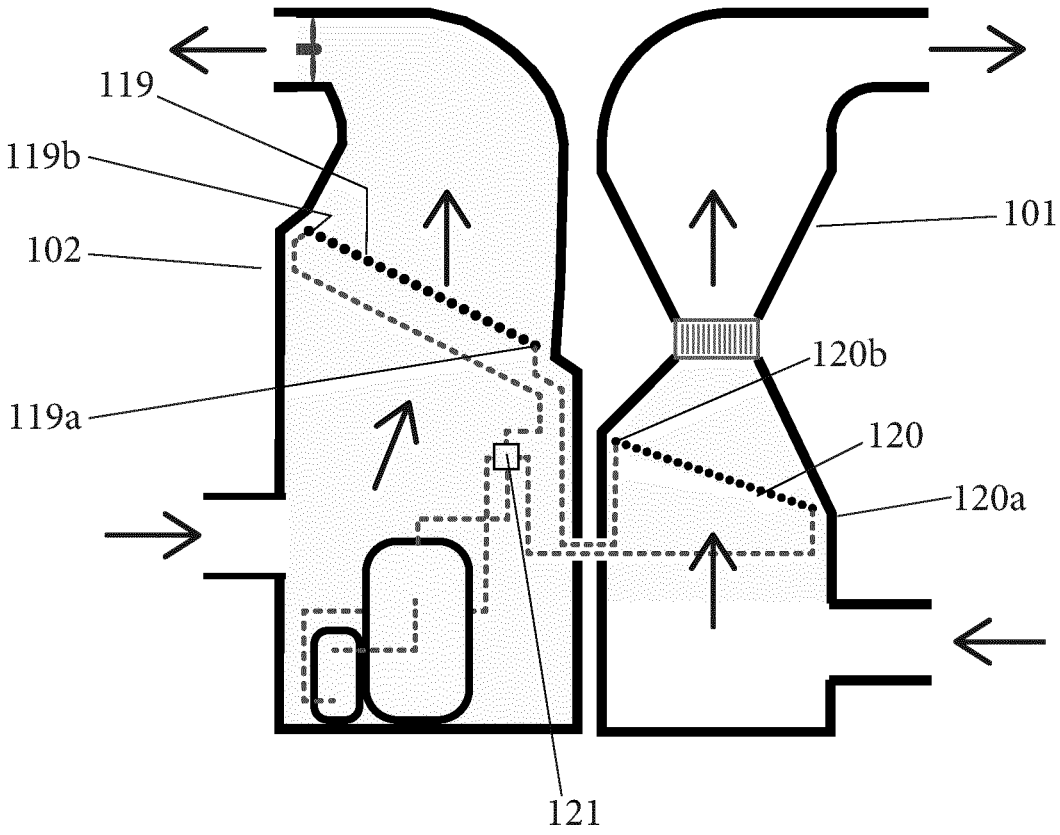
FIG. 2 is a cross sectional view of a heat exchanger core in accordance with the present invention.
Figure 3:
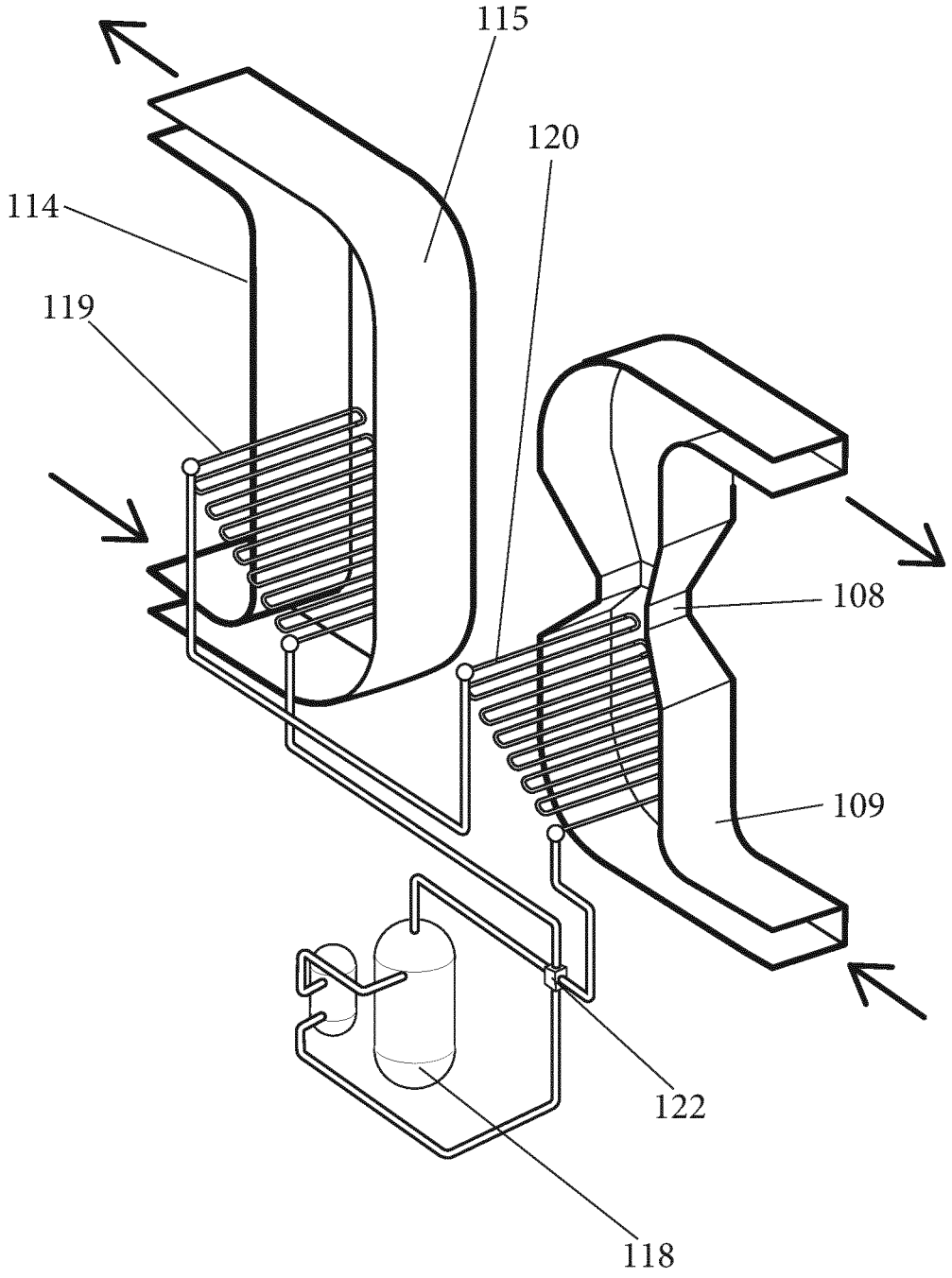
FIG. 3 is cross sectional view of the heat exchanger core in accordance with the present invention.

The first and second flue elements 116, 117 of FIG. 1 intake and exhaust the air at substantially right angles to the chamber body, however, it will be appreciated that the first and second flue elements are not restricted as such. The flue sections may have a depth and width substantially similar to the depth and width of the chamber body. The flue sections may be C-shaped, L-shaped or the like. The flue elements in the embodiment of FIG. 1 intake and exhaust perpendicular to the first wall of the second chamber. In the embodiment of FIG. 2, the intake flue elements are substantially U-shaped. The flue elements may be separate or integral elements to the first and second chamber bodies.

Fan elements (not shown) may be provided in the intake flues for improving the intake of air. Second fan elements (not shown) may be provided in the exhaust flues for exhausting the air. Fan elements may be inverter driven using variable speed control to regulate required airflow.

In the configuration of FIG. 1, the second wall of the first chamber 110, and the second wall of the second chamber 115 are aligned in a back to back configuration such that the intake flue of the first chamber and the intake flue of the second chamber are on opposite sides of the arrangement of FIG. 1. Similarly the outlet flue of the first chamber and the outlet flue of the second chamber are on opposing sides of the chambers when aligned.

A compressor unit 118 for condensing refrigerant for the heat exchange unit will be described in further detail below. The compressor unit may be external to the first and second chambers as in FIG. 1 or incorporated within the second chamber as in FIG. 2. The compressor unit 118 circulates refrigerant through evaporator and condenser coils located in the first and second chamber respectively forming a heat exchange circuit. The compressor unit pulls cold, low pressure refrigerant through the evaporator and condenser coils. The refrigerant may be a low GWP (global warming potential) refrigerant. For example, the refrigerant may be R32. In one configuration the refrigerant may be operating at for example at 0.25 kwh (or less) when the room is within 1.5 to 2 degrees Celsius of user set operating temperature (based on 3.0 kW Heating or 2.5 k cooling capacity). It will be appreciated that other refrigerants may be used including R410A, R22, R407C, R290 or the like. Natural refrigerants such as Ammonia (R717), Carbon Dioxide (R744), Water (R718), and similar may also be used. Refrigerant is hermetically sealed within the refrigerant circuit contained within the unit. Service ports may also be provided to accommodate initial refrigerant charge, and future addition/removal of refrigerant if required. One or more service ports may be provided. In one example, a service port may be provided where the pressure of the refrigerant in the circuit is high, i.e. the high pressure side and a second port may be provided where the pressure of the refrigerant in the circuit is low, i.e. the low pressure side. It will further be appreciated that the refrigerant circuit may also include a receiver tank for containing excess refrigerant which may not be in circulation but which is available for circulation. The refrigerant circuit may also include a drying element which can capture and remove excess moisture from the refrigerant circuit. It would be appreciated that excess moisture inhibits the function of the refrigerant circuit.

The first chamber 101 includes an evaporator coil 120. The second chamber 102 includes a condenser coil 119. Evaporator and condensing coils can be formed from copper, steel, aluminum, or other materials with equivalently high thermal conductivity values. The coils may include fins to increase performance of heat transfer. The coils may be coated in an anti-corrosion solution.

An expansion valve 121 relieves pressure from the refrigerant prior to the refrigerant entering a first end of the evaporator coil. The coolant circulates through the evaporator coil to the second end. As the coolant warms up it expands, before passing to the first end of the condenser coil in the second chamber. Cold air drawn in through the air inlet on the second chamber passes over the condenser coil transporting the warm refrigerant. The cold air cools the refrigerant in the coil before and thus heats up. Warm air is vented through the air outlet in the second chamber. The refrigerant then passes from the second end of the condenser coil back to the compressor unit. It will be appreciated that the evaporator coil and the condenser coil form a circuit for circulating refrigerant between the first heat exchange coil and the second heat exchange coil.

While described above as a cooling function, it will be appreciated that refrigerant may be switched to flow in the opposite direction, thus providing a heating rather than a cooling function. In this configuration the evaporator coil in the first chamber acts as a condenser coil while the condensation coil in the second chamber acts as an evaporator coil. Thus the cooling unit may then be used as a heating unit. In an embodiment a four way reversing valve is provided. This reversing valve may be operated by a solenoid. The reversing valve can be used to switch refrigerant flow on demand.

In accordance with the present invention, both the condenser coil and the evaporator coil are inclined with respect to the air inlets. This inclination is described in further detail below. The condenser coil slopes from a first end, 120*a* where the coolant enters the condenser coil towards the second end 120*b* of the condenser coil where the coolant exits the condenser coil. This condenser coil extends from the first wall of the first chamber 109 towards the second wall 110 of the chamber thus maximizing the surface area over which the air flows between the inlet and the outlet of the first chamber. The evaporator coil 119 slopes from a first end 119*a* where the refrigerant is returned to the condenser unit 118 towards the second end 119*b* of the evaporator coil where the refrigerant enters the evaporator coil from the condenser coil. The evaporator coil extends from the second wall of the second chamber 115 towards the first wall of the second chamber 111. This configuration maximizes the surface area over which the air flows between the inlet and the outlet of the second chamber. The condenser coil and the evaporator coil are in one configuration at an angle of between 30 degrees and 50 degrees with the horizontal. In a further configuration, the condenser coil and the evaporator coil are at an angle of between 15 degrees and 75 degrees with the horizontal as shown in FIG. 2. The horizontal is in parallel with the air intake to the first and second chamber as shown in FIG. 2.

Figures 4, 4A:
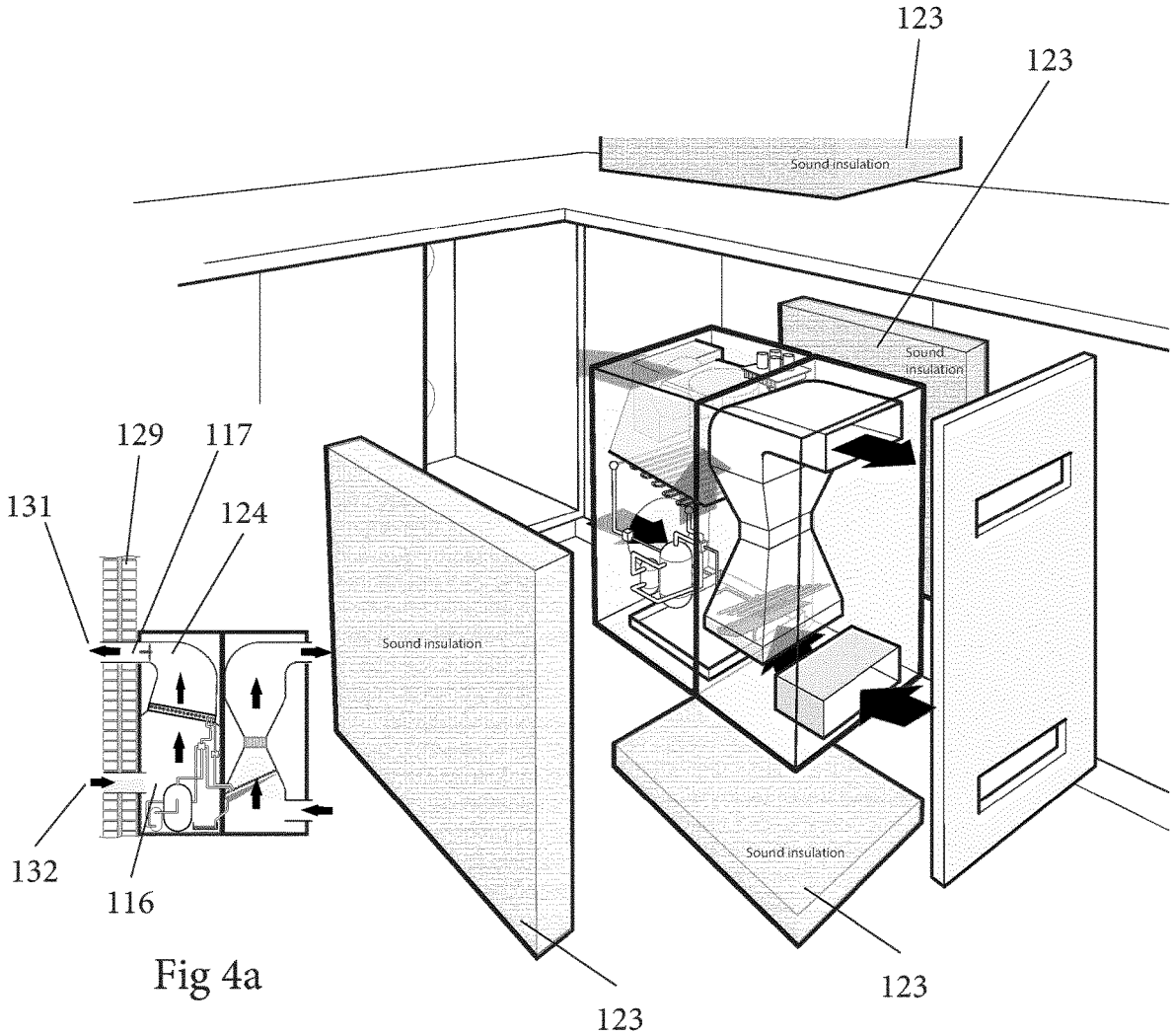
FIG. 4 is an air conditioning/heat exchange unit incorporating the heat exchanger core in accordance with the present invention and suitable for installation in a wardrobe or kitchen cupboard.

In the embodiment of FIG. 4, an air conditioning unit/heat exchanger incorporates additional sound insulation 123 to minimize noise transfer associated with the heat exchange function. Additional dampers may also be provide to dampen vibrations associated with the air conditioning unit/heat exchanger.

FIG. 4*a* provides an air flow depiction for an air conditioning unit installed on an external wall 129. A back plate is provided for mounting on the wall. Vents 131,132 are provided in communication with the chimney or flue inlet, 116, or outlet, 117 of the second chamber. An additional fan unit 124 is provided for improving the air flow from the air outlet 117 of the second chamber. Air enters the air inlet from the atmosphere and passes over the condenser coil 119. By passing over the inclined condenser coil heat is transferred from the refrigerant in the condenser coil to the air, which is then vented as hot air. In the first chamber air is extracted from the room in which the air conditioning unit is installed, passed over the evaporator coil 120. Heat is transferred from the air stream to the refrigerant in the evaporator coil. This air is then cooled and vented through the air outlet 104 and the chimney flue 107. In the embodiment of FIG. 4*a* the compressor unit 118 is shown as internal to the second chamber, however it will be appreciated that this unit may also be external. While not shown the external air vents 125, 126 in communication with the chimney flue inlet, 116, and outlet, 117 of the second chamber may be provided with vacuum seals.

Figure 5:
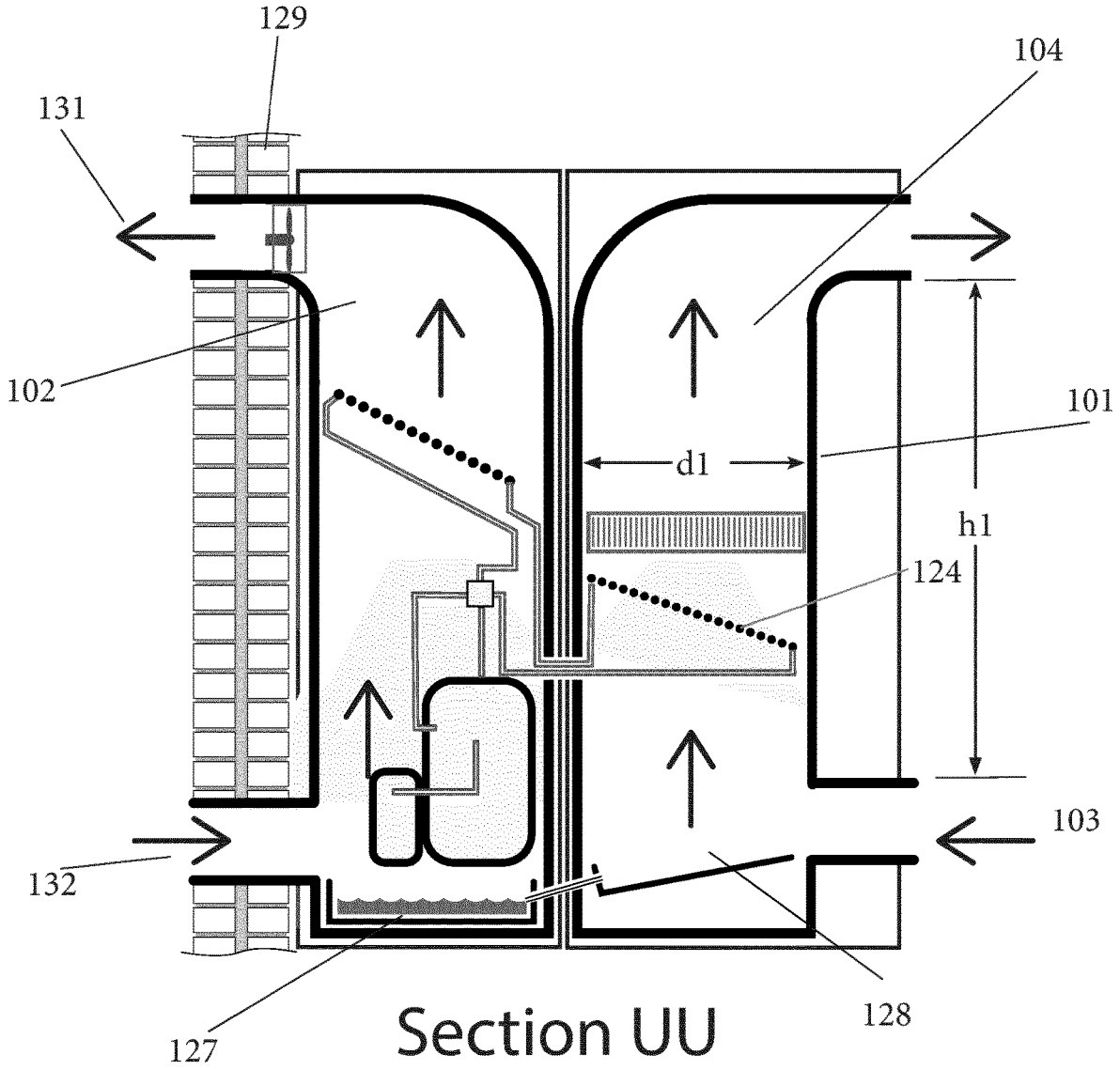
FIG. 5 is a cross sectional view of an air conditioning/heat exchange unit of FIG. 4.

A more detailed version of a similar embodiment to that shown in FIG. 4*a* is shown in FIG. 5. As described previously, a first chamber 101 and a second chamber 102 are provided with a condenser coil and an evaporator coil as discussed above. In the embodiment shown, the compressor is internal to the second chamber, however it will be appreciated that the invention is not restricted as such. In the embodiment of FIG. 5 the depth d1 of the first chamber is substantially the same along the full height, h1 of the chamber body. In this configuration a fan unit 124 is provided for assisting in the venting of the cold air from the air outlet 104. In further detail in FIG. 5 there is provided a drip tray 127 and a diverter 128. The diverter 128 diverts condensation generated by the warm air hitting the evaporator coil 120 to the drip tray. Piping can be used to drain the water externally, said piping being diverted through the air inlet of the second chamber or through a separate drain. The water can be pumped from the drip tray or may rely on gravity to drain the water from the drip tray. Alternatively an evaporation mechanism, such as a heating element or mesh is provided. This heating element or mesh causes the water from the drip tray to evaporate or mist and disperse into the airflow. It will be appreciated that these features can be incorporated into any of the alternative embodiments disclosed herein.

The embodiment of FIG. 5 is suitable for use in a cupboard or wardrobe or closet or the like.

Figure 6:
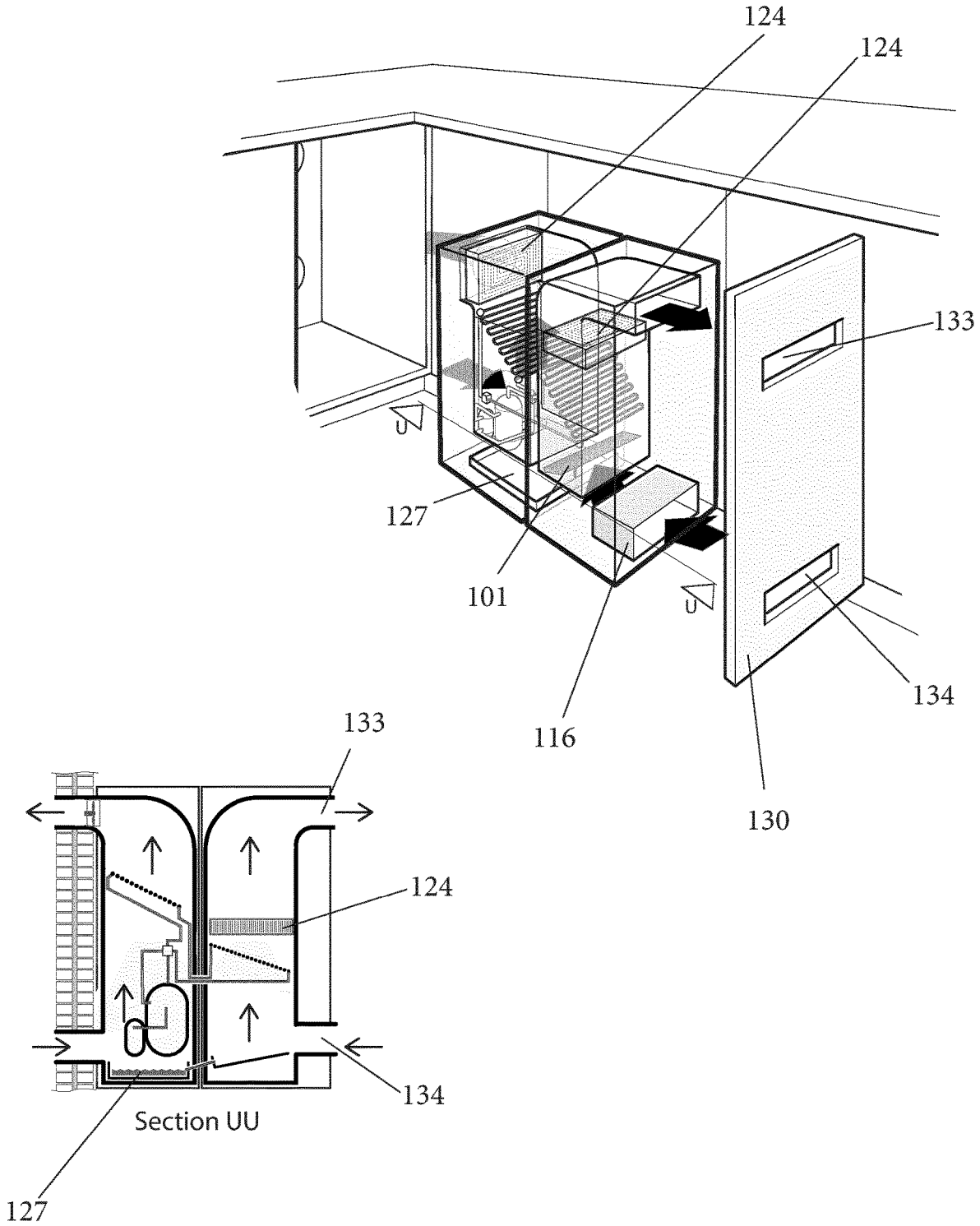
FIG. 6 is an alternative cross sectional of the air conditioning/heat exchange unit of FIG. 4

In the embodiment of FIGS. 2, 4 and 5 the air inlets of the first and second chambers are located offset from the bottom of the first chamber and the second chamber however, their location is not restricted as such. In the embodiments of FIGS. 2, 4 and 5 the location of the inlets allow for the incorporation of the drip tray and the diverter. A further embodiment is shown in FIG. 6. The configuration depicted herein is of a unit as described herein installed in a cupboard having a panel 130. The panel has two vent points 133,134 in communication with the air inlet and the air outlet of the first chamber. Air enters the heat exchange through the vent 134 and enters the air inlet chimney or flue. While a fan unit 124 is shown in FIGS. 5 and 6 it will be appreciated that the first chamber may also be narrowed as in FIG. 1. Further in the configuration of FIG. 6, the air inlet flue 116 of the first chamber is separate from the chamber body. It will be appreciated that in an alternative configuration, the air inlet flue may be integral to the chamber body. In the embodiment of FIG. 6 the depth of the chamber is substantially the same across the full height of the chamber.

In an alternative arrangement as shown in FIG. 7, there is provided an air conditioning unit 701, incorporating the heat exchanger core in accordance with the present invention. This unit is wall mounted with two vents 131, 132 communicating between the outside and chimney flue/inlet and outlet. 116,117 of the second chamber. A fan unit 124 is positioned at right angles to the condenser coil 102. A cross section (B) is shown wherein the air enters the second chamber, passes over the condenser coil which functions as outlined above. Venting is then assisted by the fan unit 124. The first chamber deviates from the configurations as described above in that the condenser coil is formed of two separate coils 120*a, b* as shown in the cross section (c). The air inlet receives the air from the chimney/flue which as shown in section (c) is a manifold having two openings. It will be appreciated that additional openings may be provided in the manifold. Air is funneled over the two condenser coils. As can be seen in the configuration provided the two coils are convergent in a v-shaped configuration pointing towards the vent point of the first chamber 107. In this configuration the vent 107 is in the top of the air conditioning unit. Air is diverted over the two condenser coils 120*a, b* by a fan unit.

In an air conditioning/heat exchange unit in accordance with the present invention it will be appreciated that the compressor, fan units, condenser and evaporator coils and control electronics are all contained within a single unit. A metal casing with optional sound insulation provides a box like structure for the heat exchange unit. Alternatively the external box may incorporate architectural elements or aesthetic elements to integrate with the decor of a home or building in which the unit is installed. It will be appreciated that in the configurations described no external condenser or interconnecting piping or wiring is required. In the embodiments comprising the drip tray and evaporation function, no additional drainage is required, resulting in a self-contained unit which can be installed in innovative locations such as in a cupboard. Units in accordance with the present application may be wall mounted with interchangeable decorative panels. Additional mood lighting can also be incorporated. This lighting may be LED lighting. It will be appreciated that the units as described herein could be concealed in a kitchen cupboard, or other cupboard, a wardrobe or the like. Additionally or alternatively such units could be incorporated at kickboard or low level in a kitchen. Venting may be through a grille or other removable section. Units as described herein could also be incorporated in a top-board or upper cupboard. Venting again could be through a grille or other removable panel. The contained nature of the heat exchange unit facilitates a plurality of installation locations such as in fireplaces, in wardrobes, in standalone cupboards or in custom pieces of furniture. Control of the heating or air conditioning function may be remote. Bluetooth or other wireless controllers can be provided for controlling the function of the units. Similarly wireless capability such that the unit is controllable from a smartphone application. Additional timers may be implemented for controlling the functionality of the device. It will also be appreciated that the air conditioning units as outlined above may also be suitable for use in a server racking design.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A heat exchanger core comprising:

(a) a first chamber comprising (i) a first chamber body having a first wall and a second wall which are substantially parallel, wherein the first wall of the first chamber comprises an air inlet and an air outlet, and wherein the first chamber body extends between the air inlet and the air outlet, and wherein a portion of the first wall separates the air inlet and the air outlet, (ii) a first heat exchange coil proximal to the air inlet and inclined with respect to the air inlet, wherein the first heat exchange coil slopes from the first wall of the first chamber adjacent to the air inlet to the second wall of the first chamber;

(b) a second chamber comprising (i) a second chamber body having a first wall and a second wall which are substantially parallel, wherein the first wall of the second chamber body comprises an air inlet and an air outlet, and wherein the second chamber body extends between the air inlet and the air outlet, and wherein a portion of the first wall separates the air inlet and the air outlet, (ii) a second heat exchange coil proximal the air inlet and inclined with respect to the air inlet, wherein the second heat exchange coil slopes from the second wall of the second chamber proximal the air inlet to the first wall of the second chamber, wherein the second wall of the second chamber is arranged in parallel in a back-to-back arrangement with the second wall of the first chamber, and wherein the air inlet for the first chamber is substantially opposite the air inlet for the second chamber, and wherein the air outlet for the first chamber is substantially opposite the air outlet for the second chamber in the back-to-back arrangement; and wherein (c) the first heat exchange coil and the second heat exchange coil are connected to form a circuit for circulating refrigerant between the first heat exchange coil and the second heat exchange coil, wherein the circuit further comprises a compressor unit located within the second chamber body.

2. The heat exchanger core according to claim 1, wherein:

(a) the first heat exchange coil comprises a first coil portion and a second coil portion, (b) the first coil portion of the first heat exchange coil slopes from the first wall to a mid-point of the first chamber, and wherein (c) the second coil portion of the first heat exchange coil slopes from the second wall to the mid-point of the first chamber.

3. The heat exchanger core according to claim 1, wherein the first heat exchange coil slopes at an angle of between 15 to 75 degrees with respect to the air inlet for the first chamber.

4. The heat exchanger core according to claim 3, wherein the second heat exchange coil slopes at an angle of between 15 and 75 degrees with respect to the air inlet for the second chamber.

5. The heat exchanger core according to claim 1, wherein the first chamber body comprises (a) a first volume adjacent the air inlet of the first chamber, (b) a second volume adjacent the air outlet of the first chamber, and (c) a third volume between the first heat exchange coil and the air outlet of the first chamber, wherein the third volume is less than the first volume and less than the second volume.

6. The heat exchanger core according to claim 1, wherein the first chamber and second chamber are positioned adjacent to one another such that the second wall of the first chamber and the second wall of the second chamber are in parallel.

7. The heat exchanger core according to claim 1 further comprising a means for collecting condensation from the first heat exchange coil.

8. The heat exchanger core according to claim 7 wherein the means for collecting condensation comprises a drip tray and a diverter configured to divert condensation from the first heat exchange coil to the drip tray.

9. The heat exchanger core according to claim 8, wherein the drip tray further comprises a heating element configured to evaporate the condensation.

10. The heat exchanger core according to any claim 1, wherein the second chamber further comprises a fan unit.

11. The heat exchanger core according to claim 10 wherein, the fan unit is an inverter driven exhaust fan.

12. The heat exchanger core according to any claim 1, wherein the circuit further comprises a reversing valve configured to reverse the refrigerant flow in the circuit.

13. The heat exchanger core according to claim 1, wherein (a) the first heat exchange coil is an evaporator coil and the second heat exchange coil is a condenser coil, or wherein (b) the first heat exchange coil is a condenser coil and the second heat exchange coil is an evaporator coil.

14. The heat exchanger core according to claim 1 further comprising a housing, wherein the housing is sized to accommodate the heat exchanger core within the housing.

15. The heat exchanger core according to claim 14, wherein the housing comprises sound insulation.

16. The heat exchanger core according to claim 15, wherein the housing comprises a fan unit.

17. The heat exchanger core according to claim 16, wherein the housing comprises (a) a housing air inlet in communication with the air inlet of the first chamber, and (b) a housing air outlet in communication with the air outlet of the first chamber.

18. The heat exchanger core according to claim 17, wherein the housing comprises (a) a housing air inlet in communication with the air inlet of the second chamber, and (b) a housing air outlet in communication with the air outlet of the second chamber.

19. The heat exchanger core according to claim 18 further comprising sealing elements engaged with the housing air inlet and the housing air outlet.

20. The heat exchanger core according to claim 19 further comprising means for mounting the air conditioning unit on a wall or other planar surface.

21. A heat exchanger core according to claim 14, wherein the housing is selected from a cupboard housing or a wardrobe housing.

* * * * *